US009214308B2

(12) United States Patent
Wang et al.

(10) Patent No.: US 9,214,308 B2
(45) Date of Patent: Dec. 15, 2015

(54) SEALING TYPE AUTOMOTIVE RELAY WITH A SAFETY DEVICE

(75) Inventors: Linhu Wang, Hengxi Town (CN); Hewei Qian, Hengxi Town (CN); Xiaowei Qian, Hengxi Town (CN); Jilun Wang, Hengxi Town (CN)

(73) Assignee: NINGBO YINZHOU YONGLIN ELECTRON ELECTRICAL EQUIPMENT CO., LTD., Ningbo (CN)

( * ) Notice: Subject to any disclaimer, the term of this patent is extended or adjusted under 35 U.S.C. 154(b) by 0 days.

(21) Appl. No.: 14/382,329

(22) PCT Filed: Jul. 20, 2012

(86) PCT No.: PCT/CN2012/078957

§ 371 (c)(1),
(2), (4) Date: Sep. 1, 2014

(87) PCT Pub. No.: WO2014/012253

PCT Pub. Date: Jan. 23, 2014

(65) Prior Publication Data

US 2015/0130568 A1 May 14, 2015

(51) Int. Cl.
*H01H 50/02* (2006.01)
*H01H 85/02* (2006.01)
(Continued)

(52) U.S. Cl.
CPC ..... *H01H 50/023* (2013.01); *H01H 50/02* (2013.01); *H01H 50/021* (2013.01); *H01H 50/18* (2013.01);
(Continued)

(58) Field of Classification Search
CPC ... H01H 50/02; H01H 50/021; H01H 50/023; H01H 85/0241
USPC ..... 335/78–86
See application file for complete search history.

(56) References Cited

U.S. PATENT DOCUMENTS 5,132,653 A * 7/1992 Nakatake et al. ..... 335/202
6,320,486 B1 * 11/2001 Dietrich et al. ..... 335/78
(Continued)

FOREIGN PATENT DOCUMENTS

CN 101459015 A 6/2009
CN 202285222 U 6/2012
WO WO-2011/045591 A1 4/2011

OTHER PUBLICATIONS

International Search Report for the Application No. PCT/CN2012/078957 mailed Apr. 25, 2013.

*Primary Examiner* — Ramon Barrera
(74) *Attorney, Agent, or Firm* — Cheng Law Group, PLLC

(57) ABSTRACT

The present invention provides a sealing type automotive relay with a safety device in the field of automotive relays, which addresses the problems of inconvenient fuse replacement and poor sealing property of the fuse in the existing relays. The sealing type automotive relay with a safety device comprises a relay main body and a safety device. The relay main body includes a base, a casing and a weak current system and a strong current system located on the base. The casing is fixedly connected with the base. The safety device includes two fuse sockets positioned on the base and a fuse inserted between the said two fuse sockets. The top of the casing is provided with a fuse inserting hole corresponding to the said two fuse sockets. The fuse is inserted into the inserting hole. A sealing cover is provided at the port of the fuse inserting hole. The sealing cover is sealedly connected to the port of the fuse inserting hole and the inner cavity of the sealing cover together with the fuse inserting hole forms a sealed cavity. The said fuse is located within the sealed cavity. The relay of the invention has advantages including good sealing property, convenience in fuse replacement and strong universality.

14 Claims, 3 Drawing Sheets

(51) Int. Cl.

| | |
|---|---|
| ***H01H 50/18*** | (2006.01) |
| ***H01H 50/44*** | (2006.01) |
| ***H01H 89/00*** | (2006.01) |
| *H01H 9/10* | (2006.01) |
| *H01H 50/04* | (2006.01) |

(52) U.S. Cl.
CPC ..... *H01H 50/44* (2013.01); *H01H 85/0241* (2013.01); *H01H 89/00* (2013.01); *H01H 9/10* (2013.01); *H01H 50/048* (2013.01); *H01H 2223/00* (2013.01)

(56) References Cited

U.S. PATENT DOCUMENTS

| | | | | |
|---|---|---|---|---|
| 7,061,351 | B2 * | 6/2006 | Suzuki et al. | 335/78 |
| 7,212,089 | B2 * | 5/2007 | Nakamura et al. | 335/78 |
| 7,355,502 | B1 * | 4/2008 | Nguyen et al. | 337/186 |

* cited by examiner

SEALING TYPE AUTOMOTIVE RELAY WITH A SAFETY DEVICE

BACKGROUND OF THE INVENTION

1. Field of Invention

The present invention relates to an automotive relay, in particular, to a sealing type automotive relay with a safety device.

2. Related Art

Automotive relays are mainly used to control switch of large currents, and could only work stably and reliably where an overload protection is available when the current is overloaded. There is no safety device in the strong current switching circuit in the existing automotive relays. The automotive relays have a small volume and the switch circuits are large, and the automotive relays have to stand vibration and high temperature, for which the space is insufficient where a safety device has to be loaded. Therefore, it is difficult to add a safety device to the automotive relays. If the volume of the automotive relay is to be increased, a fuse has to be added to the relay, which is unacceptable in new automotives.

In order to improve the quality of automotive relays and meet technical requirements for the product to be used in different environments, some technical measures are employed. For example, a safety device is provided next to the main body of the automotive relay and a connection element is used for connection. However, the volume and contact resistance of the automotive relay will be increased as such. Consequently, the reliability of the product can not be guaranteed and the problem that the product has a relatively large volume can not be efficiently addressed.

In order to address the problems as mentioned above, an automotive relay with a safety device is disclosed in a patent No. 200810164226.X, the publication number of which is CN101459015A. The automotive replay comprises a relay main body and a safety device. The relay main body includes a weak current system, a strong current system, a base and a casing. The weak current system includes an iron core, a coil, a yoke iron, an armature and an armature compression spring. The safety device includes two fuse sockets and a fuse inserted between two fuse sockets. The upper part of one fuse socket is a plug connector and the lower part hereof is a stationary article in which the stationary article is fixed on the yoke iron. The upper part of the other fuse socket is a plug connector in which an insulation spacer is provided between the plug connector and the yoke iron, and the lower part thereof has a power supply pin and a stationary pin in which the power supply pin passes through the base and the position thereof then is restricted on the base and the stationary pin is inserted onto the base. The top of the casing is provided with a fuse inserting hole corresponding to two fuse sockets, into which the fuse is inserted. Even though the said technical solution well addresses the aforesaid problem about the product volume and contact resistance, some problems still exist. For example, the relays usually have to work in the environment where the temperature changes sharply, the air humidity changes sharply and it rains, snows and ices, and the ambient working environment is with moisture and water, for which this technical solution does not have a good sealing effect. The water will easily enter into the relay through the fuse inserting hole. As a result, various electronic components of the relay will be damaged and corroded for a long period, for which the relay could not work normally and even serious safety accidents could take place in use. At present, the sealing cover could also be adhered to the port of the fuse inserting hole through a sealant, and the fuse could be sealed into the fuse inserting hole. However, firstly, the fuse has to be replaced and the sealant has to be destroyed to separate the sealing cover from the port of the fuse inserting hole when the fuse is replaced. A new fuse can only be mounted after the old fuse is taken out, and the sealant has to be used for sealing and gluing, which is quite troublesome. Secondly, the automotive is in vibration in operation leading to a poor sealing and gluing effect over time. A gap occurs between the sealing cover and the port of the fuse inserting hole, which results in a poor sealing effect.

SUMMARY OF THE INVENTION

In order to address the aforesaid defects existing in the prior art, the present invention provides a sealing type automotive relay with a safety device which has a good sealing property to better protect the fuse and various components in the relay to prolong the use life of the relay, and provides convenience and expedition in fuse replacement.

It is therefore an object of the present invention to provide a sealing type automotive relay with a safety device, comprising a relay main body and a safety device. The relay main body includes a base, a casing and a weak current system and a strong current system located on the base. The casing is fixedly connected with the base. The safety device includes two fuse sockets positioned on the base and a fuse inserted between the said two fuse sockets. The top of the casing is provided with a fuse inserting hole corresponding to the said two fuse sockets. The fuse is inserted into the inserting hole. A sealing cover is provided at the port of the fuse inserting hole. The sealing cover is sealedly connected to the port of the fuse inserting hole and the inner cavity of the sealing cover together with the fuse inserting hole forms a sealed cavity. The said fuse is located within the sealed cavity.

The weak current system includes an iron core, a coil, a yoke iron, an armature and an armature compression spring. The upper part of one fuse socket is a plug connector and the lower part hereof is a stationary article in which the stationary article is fixed on the yoke iron. The upper part of the other fuse socket is a plug connector in which an insulation spacer is provided between the plug connector and the yoke iron, and the lower part thereof has a power supply pin and a stationary pin in which the power supply pin passes through the base and the position thereof then is restricted on the base and the stationary pin is inserted onto the base. The upper part of the fuse socket is a standard plug connector and the stationary pin is fixed on the corner of the base.

In the sealing type automotive relay with a safety device, the port of the fuse inserting hole projects upward to form a convex member having an upper part and a lower part. An outer step is formed between the upper part and the lower part. A sealing ring is covered on the outer step. The sealing cover includes an upper end portion and a lower end portion. An inner step is formed between the upper end portion and the lower end portion. When the sealing cover is to be fixed on the convex member, the sealing ring is pressed and connected between the outer step and the inner step to form a sealed connection between the sealing cover (5) and the port of the fuse inserting hole.

In the sealing type automotive relay with a safety device, the sealing cover is fixedly connected with the convex member through a snap-fit structure.

In the sealing type automotive relay with a safety device, the snap-fit structure includes two bumps fixedly connected to both end side walls of the lower part of the convex member respectively, and two slots opened on both end side walls of the lower end portion of the sealing cover respectively. The said two slots could be engaged with the said two bumps respectively to fix the sealing cover onto the convex member.

The fixing mode by the snap-fit structure makes the sealing cover removable from the convex member, which provides convenient and expeditious fuse replacement. Meanwhile, the pressing and sealing effect of the outer step and inner step upon the sealing ring could be improved to enhance the sealing property.

In the sealing type automotive relay with a safety device, the upper end surface of the said two bumps is an inclined guide surface, and the said two slots could slide into the said two bumps as guided by the guide surface of two bumps to form a snap-fit connection.

The guide surface could achieve a very good guiding function, so that the sealing cover could be conveniently fixed on the convex member.

In the sealing type automotive relay with a safety device, the casing is fixedly connected to the base through a clamping mechanism.

In the sealing type automotive relay with a safety device, the clamping mechanism includes two strip-like fixture blocks fixedly connected to two opposite side walls of the base respectively and two grooves opened on the inner side wall at the port of the casing corresponding to the said two strip-like fixture blocks respectively. An inclined guide slope is provided between the groove and the port on the inner side wall at the port of the casing. When a clamping connection is required, two strip-like fixture blocks could slide into two grooves on the inner side wall at the port of the casing along the said tow guide slopes respectively, to form a clamping connection.

The fixed connection by the clamping structure makes the casing removable from the base, which provides a very good fixing effect between the casing and the base in the meantime. The good guiding effect of the guide slopes facilitates engagement of the two strip-like fixture blocks with two grooves, so that the casing could be conveniently and expeditiously fixed onto the base.

In the sealing type automotive relay with a safety device, the casing is a transparent casing and an opaque casing.

The transparent casing helps people to conveniently understand the conditions of various components on the base without opening the casing, and to find out any problems of the components in time.

Compared with the prior art, the sealing type automotive relay with a safety device has the following advantages.

First, the sealing ring is directly covered onto the outer step of the convex member. When the sealing cover is mounted on the convex member via a snap-fit structure, the sealing ring is located between the outer step of the convex member and the inner step of the sealing cover and pressed and sealed by the steps to closely engage the sealing cover with the convex member. The pressing of the sealing ring and the close engagement of the convex member of the casing with the sealing cover achieve double insurance for sealing, largely improve the sealing property of the relay, and address the sealing function of the relay well. Meanwhile, the problem of a small mounting space could be addressed. The relay volume will not be enlarged and the contact resistance will not be increased as well. The relay could stand some vibration, and has a reasonable structure, a good fixing effect, convenience in mounting and use, and high reliability.

Second, the fuse is sealed into the sealed cavity formed by the inner cavity of the sealing cover and the fuse inserting hole, to avoid being influenced by the outer poor environment. Meanwhile, the removable snap-fit connection between the sealing cover and the convex member of the casing provides more convenience and expedition in fuse replacement.

Third, the pressed sealing ring replaces the old sealing mode of a sealant, preventing vibration or unreliability in contact caused by frequent draw-in and draw-out or loosening of the plug. This said, the fuse could stably and reliably work in the environment of salt mist or humid air.

Fourth, the automotive relay has a strong universality. A safety sealing device could be directly added to the replay products, to improve the product qualification rate and the product standardization degree. As such, the production efficiency is enhanced and the cost is saved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Embodiments of the present invention will be described in detail below with reference to the drawings. However, the present invention shall not be limited to these embodiments.

Figure 1:
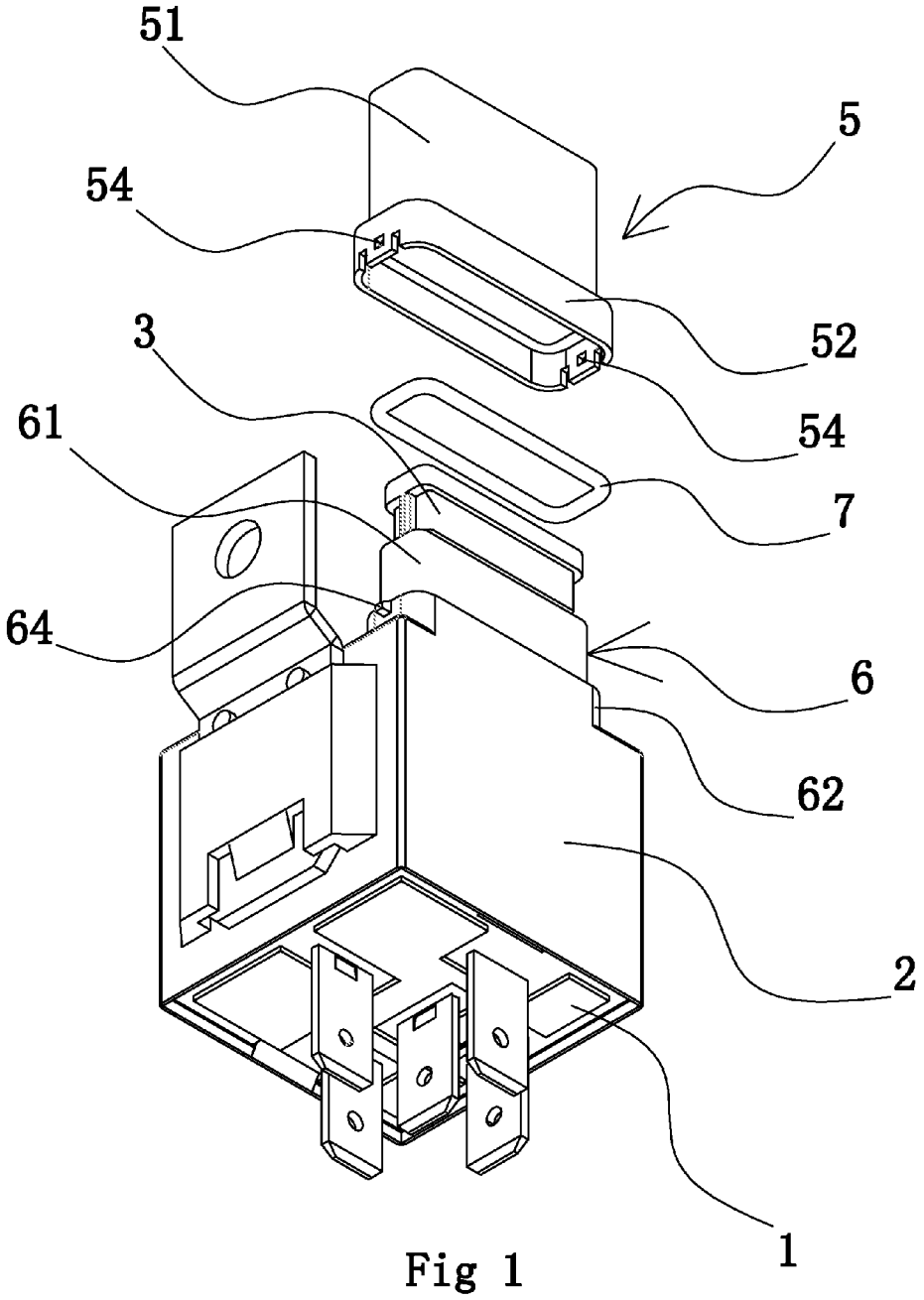
FIG. 1 is a diagram of a stereoscopic structure according to the invention.
Figure 2:
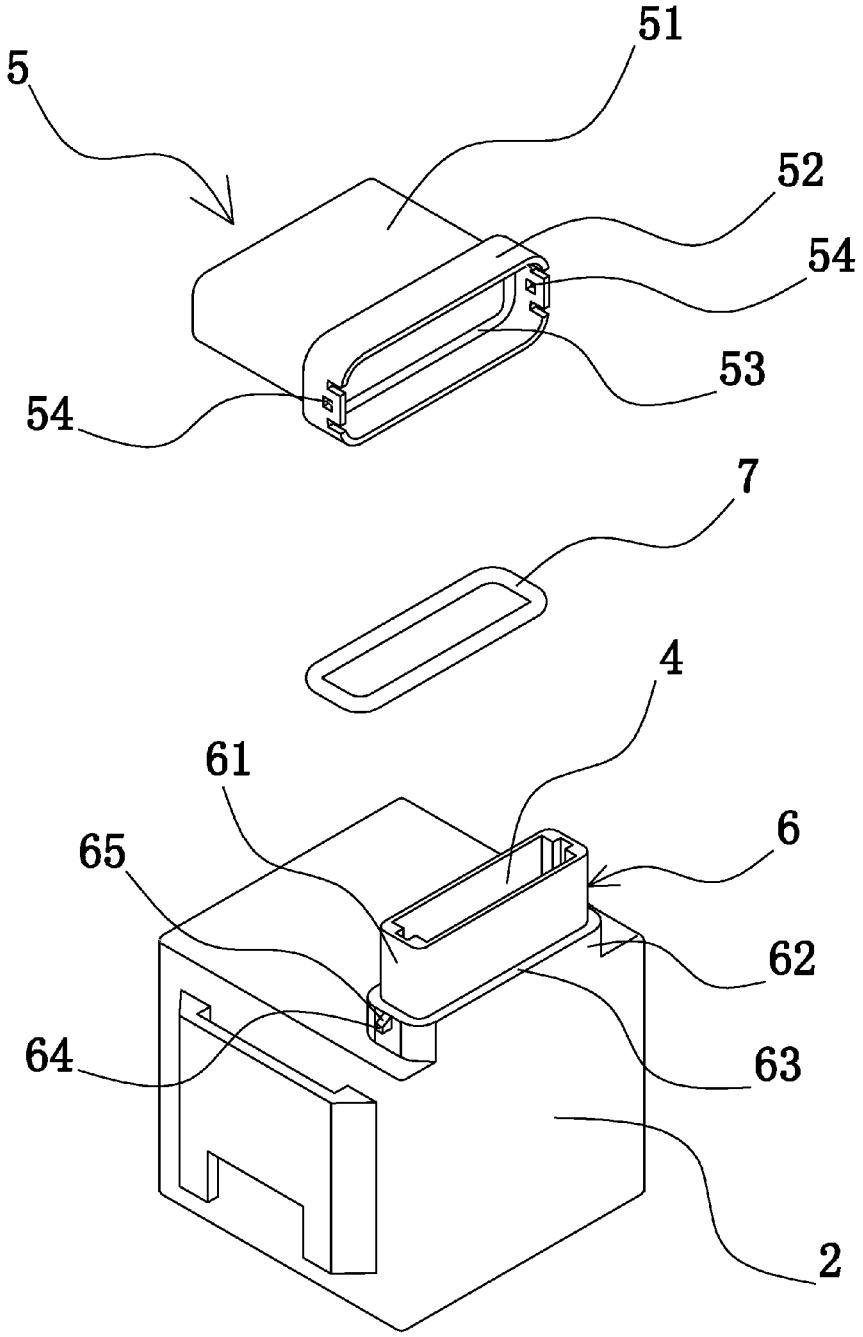
FIG. 2 is a diagram of the other structure according to the invention.
Figure 3:
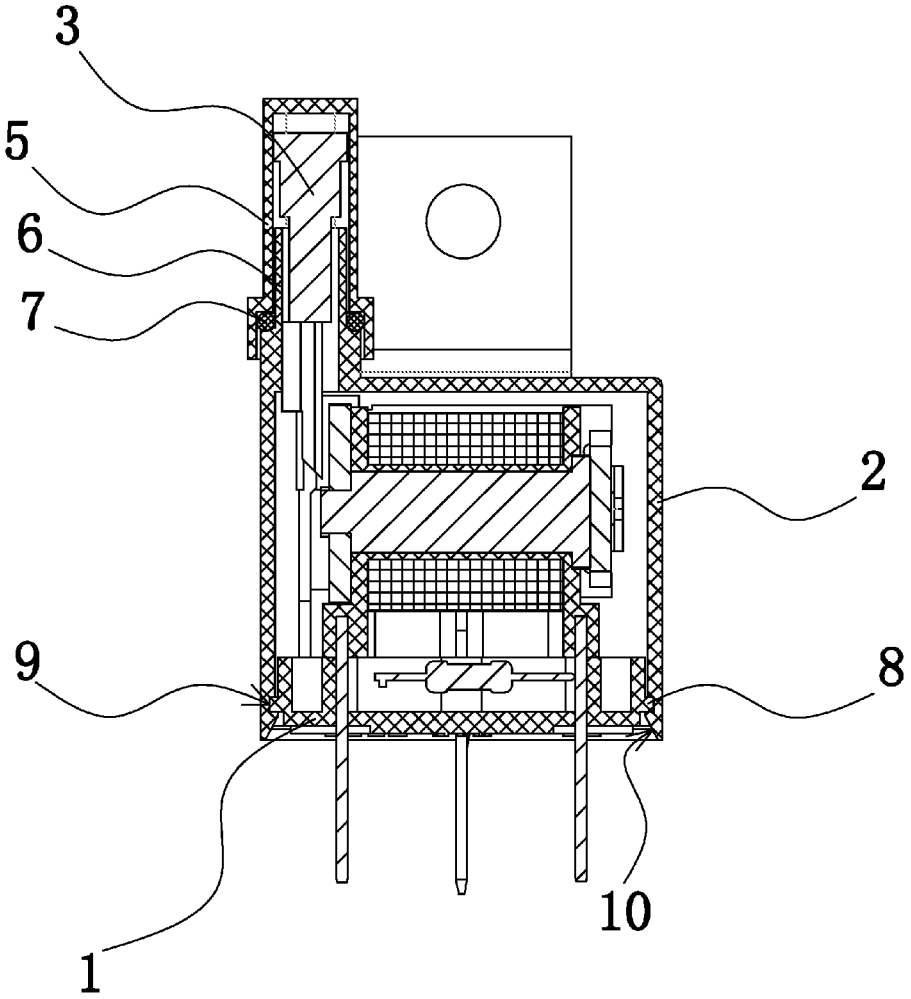
FIG. 3 is a section view of the invention.

As shown in FIGS. 1, 2 and 3, the sealing type automotive relay with a safety device of the invention comprises a relay main body and a safety device. The replay main body includes a base 1, a casing 2, and a weak current system and a strong current system positioned on the base 1. The casing 2 is fixedly connected to the base 1. The safety device includes two fuse sockets located on the base 1 and a fuse 3 inserted between the said two fuse sockets. The top of the casing 2 is provided with a fuse inserting hole 4 corresponding to two fuse sockets. The fuse 3 is inserted into the inserting hole. A sealing cover 5 is provided at the port of the fuse inserting hole 4. The port of the fuse inserting hole 4 projects upward a convex member 6 having a upper part 61 and a lower part 62. An outer step 63 is formed between the upper part 61 and the lower part 62. A sealing ring 7 is covered on the outer step 63. The sealing cover 6 has an upper end portion 51 and a lower end portion 52. An inner step 53 is formed between the upper end portion 51 and the lower end portion 52. When the sealing cover 5 is fixed on the convex member 6, the seal ring 7 is pressed and connected between the outer step 63 and the inner step 53 to form a sealed connection between the sealing cover 5 and the port of the fuse inserting hole 4, thereby forming a sealed cavity between the inner cavity of the sealing cover 5 and the fuse inserting hole 4. The fuse 3 is located within the sealed cavity.

Furthermore, the sealing cover 5 is fixedly connected with the convex member 6 through a snap-fit structure. The snap-fit structure includes two bumps 64 fixedly connected to both end side walls of the lower part 62 of the convex member 6 respectively, and two slots 54 opened on both end side walls of the lower end portion 52 of the sealing cover 5 respectively. The upper end surface of two bumps 64 is an inclined guide surface 65. When the sealing cover 5 is mounted onto the convex member 6, two slots 54 could slide into both bumps 64 as guided by the guide surface 65 of two bumps 64 to form a snap-fit connection which fixes the sealing cover 5 onto the convex member 6. The sealing cover 5 is removably fixed to the convex member 6. The sealing cover 5 could be pressed and fixed on the convex member 6 of the casing 2 via snap fit in the process of sealed mounting. The sealing ring 7 is located between the outer step 63 of the convex member 6 and the inner step 53 of the sealing cover 5 and pressed and deformatively sealed by the outer step 63 and the inner step 53. Meanwhile, the sealing cover 5 is closely engaged with the convex member 6, which provides double insurance for sealing, improves the sealing property of the relay, and prevents outer poor environment influencing the fuse 3 and various components within the relay. When the fuse 3 has to be replaced, only the sealing cover 5 has to be removed from the convex member 6 and is then mounted onto the convex member 6 again via snap fit after the new fuse 3 is in position, which is convenient, expeditious and has a good effect.

Moreover, the casing 2 is fixedly connected to the base 1 via a clamping mechanism. The clamping mechanism includes two strip-like fixture blocks 8 fixedly connected to two opposite side walls of the base 1 respectively and two grooves 9 opened on the inner side wall at the port of the casing 2 corresponding to the said two strip-like fixture blocks 8 respectively. An inclined guide slope 10 is provided between the groove 9 and the port on the inner side wall at the port of the casing 2. When the casing 2 is to be mounted on the base 1, two strip-like fixture blocks 8 could slide into two grooves 9 along tow guide slopes 10 respectively, to form a clamping connection which fixes the casing 2 onto the base 1. The casing 2 is removably fixed to the base 1. The casing 2 could be fixed onto the base 1 in the process of production and assembly. When the casing 2 has to be opened, the casing 2 could be removed from the base 1 through the clamping mechanism.

The casing 2 in this embodiment is a transparent casing which helps people to conveniently understand the conditions of various components on the base 1 without opening the casing 2, and to find out any problems of the components in time. The casing 2 in this embodiment could be an opaque casing as well.

The specific embodiments described herein are merely illustrative of the spirit of the invention. It is apparent to those skilled in the art that various modifications, amendments and alternatives can be made to these embodiments without departing from the spirit or scope defined by the appended claims.

Even though terms for example base 1, casing 2, fuse 3, fuse inserting hole 4, sealing cover 5, upper end portion 51, lower end portion 52, inner step 53, slot 54, convex member 6, upper part 61, lower part 62, outer step 63, bump 64, guide surface 65, sealing ring 6, strip-like fixture block 8, groove 9 and guide slope 10, the other terms could also be used. The use of these terms is merely to describe and explain the essence of the invention more conveniently. It is a departure from the spirit of the invention to construe these terms as an additional limitation.

LIST OF REFERENCE NUMERALS

1 Base
2 Casing
3 Fuse
4 Fuse Inserting Hole
5 Sealing Cover
51 Upper End Portion
52 Lower End Portion
53 Inner Step
54 Slot
6 Convex Member
61 Upper Part
62 Lowe Part
63 Outer Step
64 Bump
65 Guide Surface
7 Sealing Ring
8 Strip-like Fixture Block
9 Groove
10 Guide Slope

The invention claimed is:

1. A sealing type automotive relay with a safety device, comprising a relay main body and a safety device, in which the relay main body includes a base (1), a casing (2) and a weak current system and a strong current system located on the base (1), the casing (2) is fixedly connected with the base (1), the safety device includes two fuse sockets positioned on the base (1) and a fuse (3) inserted between the said two fuse sockets, the top of the casing (2) is provided with a fuse inserting hole (4) corresponding to the said two fuse sockets, and the fuse (3) is inserted into the inserting hole, characterized in that a sealing cover (5) is provided at the port of the fuse inserting hole (4), the sealing cover (5) is sealedly connected to the port of the fuse inserting hole (4) and the inner cavity of the sealing cover (5) together with the fuse inserting hole (4) forms a sealed cavity, and the said fuse (3) is located within the sealed cavity.

2. The sealing type automotive relay with a safety device as claimed in claim 1, characterized in that, the port of the fuse inserting hole (4) projects upward to form a convex member (6) having an upper part (61) and a lower part (62), an outer step (63) is formed between the upper part (61) and the lower part (62), a sealing ring is covered on the outer step (63), the sealing cover (5) inc hides an upper end portion (51) and a lower end portion (52), an inner step (53) is formed between the upper end portion (51) and the lower end portion (52), when the sealing cover (5) is to be fixed on the convex member (6), the sealing ring (7) is pressed and connected between the outer step (63) and the inner step (53) to form a sealed connection between the sealing cover (5) and the port of the fuse inserting hole (4).

3. The sealing type automotive relay with a safety device as claimed in claim 2, characterized in that, the sealing cover (5) is fixedly connected with the convex member (6) through a snap-fit structure.

4. The sealing type automotive relay with a safety device as claimed in claim 3, characterized in that, the snap-lit structure includes two bumps (64) fixedly connected to both end side walls of the lower part (62) of the convex member (6) respectively, and two slots (54) opened on both end side walls of the lower end portion (52) of the sealing cover (5) respectively, and the said two slots (54) could be engaged with the said two bumps (64) respectively to fix the sealing cover (5) onto the convex member (6).

5. The sealing type automotive relay with a safety device as claimed in claim 4, characterized in that, the upper end surface of the said two bumps (64) is an inclined guide surface (65), and the said two slots (54) could slide into the said two humps (64) as guided by the guide surface (65) of two bumps (64) to form a snap-fit connection.

6. The sealing type automotive relay with a safety device as claimed in claim 1, characterized in that, the casing (2) is fixedly connected to the base (1) through a clamping mechanism.

7. The sealing type automotive relay with a safety device as claimed in claim 6, characterized in that, the clamping mechanism includes two strip-like fixture blocks (8) fixedly connected to two opposite side walls of the base (1) respectively and two grooves (9) opened on the inner side wall at the port of the casing (2) corresponding to the said two strip-like fixture blocks (8) respectively, an inclined guide slope (10) is provided between the groove (9) and the port on the inner side wall at the port of the casing (2), and when a clamping connection is required, two strip-like fixture blocks (8) could slide into two grooves (9) on the inner side wall at the port of the casing (2) along the said tow guide slopes (10) respectively, to form a clamping connection.

8. The sealing type automotive relay with a safety device as claimed in claim 1, characterized in that, the casing (2) is a transparent casing or an opaque casing.

9. The sealing type automotive relay with a safety device as claimed in claim 2, characterized in that, the casing (2) is a transparent casing or an opaque casing.

10. The sealing type automotive relay with a safety device as claimed in claim 3, characterized in that the casing (2) is a transparent casing or an opaque casing.

11. The sealing type automotive relay with a safety device as claimed in claim 4, characterized in that, the casing (2) is a transparent casing or an opaque casing.

12. The sealing type automotive relay with a safety device as claimed in claim 5, characterized in that, the casing (2) is a transparent casing or an opaque casing.

13. The sealing type automotive relay with a safety device as claimed in claim 6, characterized in that, the casing (2) is a transparent casing or an opaque casing.

14. The sealing type automotive relay with a safety device as claimed in claim 7, characterized in that, the casing (2) is a transparent casing or an opaque casing.

* * * * *